US010450622B2

(12) United States Patent
Arenholz et al.

(10) Patent No.: US 10,450,622 B2
(45) Date of Patent: Oct. 22, 2019

(54) METHOD FOR HEAT-TREATING A MANGANESE STEEL PRODUCT AND MANGANESE STEEL PRODUCT

(71) Applicant: VOESTALPINE STAHL GMBH, Linz (AT)

(72) Inventors: Enno Arenholz, Plesching (AT); Ludovic Samek, Linz (AT)

(73) Assignee: VOESTALPINE STAHL GMBH, Linz (AT)

( * ) Notice: Subject to any disclaimer, the term of this patent is extended or adjusted under 35 U.S.C. 154(b) by 548 days.

(21) Appl. No.: 14/653,694

(22) PCT Filed: Dec. 20, 2013

(86) PCT No.: PCT/EP2013/003898

§ 371 (c)(1),
(2) Date: Jun. 18, 2015

(87) PCT Pub. No.: WO2014/095082

PCT Pub. Date: Jun. 26, 2014

(65) Prior Publication Data

US 2016/0002746 A1 Jan. 7, 2016

(51) Int. Cl.

| | |
|---|---|
| ***C21D 6/00*** | (2006.01) |
| ***C21D 1/26*** | (2006.01) |
| ***C22C 38/02*** | (2006.01) |
| ***C22C 38/04*** | (2006.01) |
| ***C22C 38/06*** | (2006.01) |
| ***C21D 1/18*** | (2006.01) |
| *C21D 1/78* | (2006.01) |

(52) U.S. Cl.

CPC ..... *C21D 6/005* (2013.01); *C21D 1/185* (2013.01); *C21D 1/26* (2013.01); *C21D 6/008* (2013.01);

(Continued)

(58) Field of Classification Search

CPC ..... C21D 1/78; C21D 1/34; C21D 1/26
See application file for complete search history.

(56) References Cited

U.S. PATENT DOCUMENTS 4,000,018 A * 12/1976 Theckston ..... C22C 38/38 148/621
4,378,246 A * 3/1983 Hoshino ..... C22C 38/42 148/326

(Continued)

FOREIGN PATENT DOCUMENTS

| | | | |
|---|---|---|---|
| CN | 102712980 A | | 10/2012 |
| JP | 2012219342 A | * | 11/2012 |
| KR | 20040059293 A | | 7/2004 |

OTHER PUBLICATIONS

Arlazarov, A., et al. "Evolution of Microstructure and Mechanical Properties of Medium Mn Steels during Double Annealing." Materials Science and Engineering: A, vol. 542, Feb. 12, 2012, pp. 31-39 (Year: 2012).*

(Continued)

*Primary Examiner* — Colleen P Dunn
*Assistant Examiner* — Jeremy C Jones
(74) *Attorney, Agent, or Firm* — Notaro, Michalos & Zaccaria P.C.

(57) ABSTRACT

A method for heat treating a manganese steel product whose alloy comprises:

a carbon fraction (C) between 0.09 and 0.15 wt. %, and a manganese fraction (Mn) in the range of 3.5 wt. %≤Mn≤4.9 wt. %, the method comprising:

performing a first annealing process (S4.1) with the substeps heating (E1) the steel product to a first holding temperature (T1), which lies above 780° C., holding (H1) the steel product during a first time period (Δ1) at the first holding temperature (T1), cooling (A1) the steel product, performing a second annealing process (S4.2) with the substeps (Continued)

heating (E2) the steel product to a holding temperature (T2), which lies above 630° C. and below 660° C.,
holding (H2) the steel product during a second time period (Δ2) at the holding temperature (T2),
cooling (A2) the steel product.

15 Claims, 9 Drawing Sheets

(52) U.S. Cl.
CPC ..... *C22C 38/02* (2013.01); *C22C 38/04* (2013.01); *C22C 38/06* (2013.01); *C21D 1/78* (2013.01)

(56) References Cited

U.S. PATENT DOCUMENTS 5,595,610 A * 1/1997 Maeda ..... C21D 1/78 148/233
8,313,589 B2 * 11/2012 Takasawa ..... C21D 1/28 148/330
2005/0045248 A1 * 3/2005 Otani ..... C21D 1/78 148/219
2009/0098408 A1 * 4/2009 Sun ..... C21D 6/005 428/684
2010/0132849 A1 * 6/2010 Takagi ..... C21D 6/005 148/533
2011/0030857 A1 * 2/2011 Kwak ..... C21D 6/005 148/645
2013/0037180 A1 2/2013 Sano

OTHER PUBLICATIONS

International Preliminary Report on Patentability issued from the International Bureau of WIPO, dated Jun. 25, 2015.
Arlazarov, A., et al., "Evolution of microstructure and mechanical properties of medium Mn steels during double annealing", Materials and Engineering A, El Sevier, 2012.
International Search Report.
Office Action dated May 5, 2016 for Chinese Application No. CN 201380072929.9.

* cited by examiner

METHOD FOR HEAT-TREATING A MANGANESE STEEL PRODUCT AND MANGANESE STEEL PRODUCT

The present invention relates to a method for heat treatment of a manganese steel product, which is here also designated as medium manganese steel product. This also involves a special alloy of a manganese steel product which can be heat-treated within the framework of a special method.

Both the composition or alloy and also the heat treatment in the manufacturing process have a significant influence on the properties of steel products.

Thus, it is also known that within the framework of a heat treatment, the heating, holding and cooling can have an influence on the final structure of a steel product. Furthermore, as already indicated, the alloy composition of the steel product also plays a major role. The thermodynamic and materials-technology relationships in alloyed steels are very complex and depend on many parameters.

It has been shown that by combining various phases and microstructures in the structure of a steel product, the mechanical properties and the deformability can be influenced.

Depending on the composition and heat treatment, inter alia ferrite, pearlite, retained austenite, tempered martensite, martensite phases and bainite microstructures can form in steel products. The properties of steel alloys depend, inter alia, on the fractions of the various phases, microstructures and on their structural arrangement in the microscopic examination.

Simple forms of first-generation, advanced, high-strength steels have, for example, a two-phase composition of ferrites and martensites. Such steels are also designated as two-phase steels. Ferrite (depending on the arrangement also called α-Fe or δ-Fe) forms a relatively soft matrix and martensite typically forms inclusions in this matrix.

There are also first-generation complex phase steels whose microstructure comprises ferrite, bainite, tempered martensite and martensite. The more homogeneous structure of the complex phase steels results in exceptionally good bending properties compared with, for example, two-phase steels.

Second-generation steels such as, for example, TWIP steel, mostly have an austenitic microstructure and a high manganese fraction greater than 15 wt. %. TWIP stands for TWinning Induced Plasticity steel.

Each of these steels has different properties. Depending on the specific requirement profile, different steels can be used, for example, in automotive manufacture.

The carbon component (C) in such steels is typically in the range between 0.2 and 1.2 wt. %. This usually are mild steels.

Known from the publication by A. Arlazarov et al. having the title "Evolution of microstructure and mechanical properties of medium Mn steels during double annealing" in Materials Science and Engineering A, 2012, is a structure comprising ferrite, martensite and retained austenite with an alloy having 4.6 wt. % Mn. This structure is subjected to a two-stage annealing process which is shown in FIG. 4A in direct comparison with a method of the invention. The two-stage annealing process according to Arlazarov et al. is designated in FIG. 4A by e1, h1, a1 and e2, h2, a2. The structure according to Arlazarov et al. was described as a complex ultrafine microstructure which is composed of the three phases retained austenite, martensite and ferrite. The steel according to Arlazarov et al. therefore comprises a mild medium manganese steel.

An austenite structure (also called gamma-, γ-mixed crystal or γ-Fe) is a mixed crystal that can be formed in a steel product. The austenite structure has a bcc crystal structure, possesses a high thermal stability and affords good corrosion properties. By means of suitable heating and holding at a holding temperature above a threshold temperature, the structure of a steel product can be converted at least partially into austenite. There are so-called austenite formers which enlarge the austenite region or volume fraction. These include inter alia nickel (Ni), chromium (Cr) and manganese (Mn). The austenite ranges of a steel product are frequently not very stable and convert into martensite during the cooling or quenching (called martensitic conversion). As a result of the formation of martensite and precipitations which occur, undesirable crack formation can occur during the hot rolling of such steel products.

In addition to the retained austenite mentioned initially, there is also so-called reverted austenite (or "rev. austenite"). This form of austenite can be produced by a two-stage heat treatment according to Miller and Grange. This process is also known as ART heat treatment. ART stands for "Austenite Reverted Transformation". During the ART heat treatment, a reversion of martensite to reverted austenite takes place.

In addition to the austenite, martensite and ferrite phases which have already been explained, pearlite phases and bainite microstructures also occur in steels. Each of these phases or structures has its own properties. Depending on the area of application of the steel product, it is therefore a question of a suitable compromise between the various properties which partly compete with one another. Thus, for example, an increase in yield strength and strength of a steel product is at the expense of toughness.

Ferrite is a metallurgical designation of another mixed crystal, in the lattice of which carbon is interstitially dissolved (i.e. in intermediate positions of the lattice). A purely ferritic structure has a low strength but a high ductility. By adding carbon, the strength can be improved, but this is at the expense of the ductility. The cast iron described in connection with FIG. 1 is an example for such a material.

There are so-called ferrite formers which enlarge the ferrite region or volume fraction. These include, inter alia, chromium (Cr), molybdenum (Mo), vanadium (V), aluminium (Al), titanium (Ti), phosphorus (P) and silicium (Si).

FIG. 1 shows a classical, highly schematic diagram of cast iron (an iron-carbon alloy having a high carbon content of >2.06 wt. %). Two example cooling curves as a function of the temperature T [° C.] and the time t [min] are plotted in this diagram. In FIG. 1 the pearlite region is designated by 4 and the bainite region by 5. $M_S$ designates the martensite starting temperature. The corresponding line is designated in FIG. 1 with the reference number 3. The martensite starting temperature $M_S$ is dependent on the allow composition.

Pearlite is a structure in which α-ferrite and cementite lamellae (cementite is iron carbide, $Fe_3C$) are present. Bainite (also called bainitic iron) has a bcc structure. Bainite is not a phase in the actual sense, but a microstructure which forms in steel in a certain temperature range. Bainite is maily formed as austenite.

Inter alia, in such a cast iron product martensite forms at temperatures below line 3. A martensite is a fine-needled, very hard and brittle structure. It is typically formed when quenching austenite at such high quenching rates that the carbon fraction in the steel does not have time to diffuse out from the lattice. Curve 1 in FIG. 1 shows the quenching at a high cooling rate which results in the formation of a martensitic structure.

Curve 2 in FIG. 1 shows a so-called bainite heat treatment. When holding at a temperature above $M_S$, austenite can be converted to bainite if a conversion into the pearlite stage is avoided.

It can be identified in outline by means of the introductory explanations that the relationships are very complex and that frequently advantageous properties can only be achieved on the one hand if one's sights are lowered on the other hand.

In modern third-generation steel products, problems can occur primarily during forming. Inter alia it is deemed to be disadvantageous that martensite-containing steels require relatively high rolling forces during cold rolling. In addition, cracks can form in martensite-containing steels during cold rolling.

It is therefore the object to provide a method and corresponding steel products which have an optimal combination of weldability and low tendency to form cracks with good strength as well as cold formability.

Preferably the steel products of the invention should have a tensile strength which is greater than 700 MPa. Preferably the tensile strength should be even greater than 1200 MPa.

Preferably the steel products of the invention should at the same time have a better ductility and a better pliability than the first-generation steel products.

According to the invention, a steel product, preferably a cold strip steel product having an ultrafine multiphase structure with corresponding formability, is provided by a combination of method and alloy concepts. Particularly preferred embodiments have an ultrafine multi-phase bainitic structure which has a correspondingly good formability.

The alloy of the steel products of the invention has according to the invention a medium manganese content which means that the manganese fraction lies in the range of 3.5 wt. %≤Mn≤4.9 wt. %.

The steel products of the invention form a heterogeneous system or a heterogeneous structure.

The steel products of the invention preferably have according to the invention at least proportionately a bainitic microstructure. The fraction of the bainitic microstructure can be up to 20 wt. % of the steel product.

The steel products of the invention preferably have according to the invention at least proportionately a structure or regions having a bainitic microstructure and martensite.

In addition, the carbon fraction according to the invention is generally rather low. That is, the carbon fraction lies in the range of 0.1 wt. %≤C≤0.14 wt. %. The alloyed steels according to the invention therefore comprise so-called mild, hypoeutectic steels.

Such alloys lead to steel products having the desired properties if they are subjected to a two-stage heat treatment with the process steps according to patent claim 1. This special form of two-stage heat treatment has a significant influence on the formation of a multi-phase structure of the steel product.

According to the invention, the structure or the microstructure of the steel product is specifically influenced by a special two-stage heat treatment.

The two-stage heat treatment during cooling preferably comprises an interim holding phase at a temperature which lies in the range between 370° C. and 400° C. The interim holding phase has a maximum duration of 5 minutes. As a result of the holding at a temperature above $M_S$, the austenite can be at least partially converted to bainite if a conversion to the pearlite stage is avoided.

According to the invention, the alloy of the steel products comprises Al and Si components. By reducing the Al and Si fractions compared to other steels, the bainitization, i.e. the formation of bainitic microstructures, can be intensified. That is, the reduction of the Al and Si fractions as specified by the invention leads to a promotion of the bainitic conversion. This is accomplished by shifting the bainite area in the conversion diagram.

It has been shown that a too-high Cr fraction can negatively influence the bainitic conversion. Thus, in preferred embodiments of the invention, the Cr fraction is specified as a maximum of 0.4 wt. %.

By specifying the relationship between the carbon fraction and the manganese fraction, a stabilization of the austenite phase can be achieved according to the invention. Thus, in preferred embodiments the relationship between the carbon fraction and the manganese fractions is specified as follows: 0.01≤C (wt. %)/Mn (wt. %)≤0.04. The composition 0.02≤C (wt. %)/Mn (wt. %)≤0.04 yields particularly exceptional properties.

By specifying the relationship between the silicium fraction, the aluminium fraction and the chromium fraction, it is possible to achieve a stabilization of the ferritic phase(s) which has a not insignificant fraction of the ultrafine average grain size. Thus, in preferred embodiments the relationship between the silicium fraction, the aluminium fraction and the chromium fraction is specified as follows: 0.3 wt. %≤Si+Al+Cr≤3 wt. % and in particular between 0.3 wt. %≤Si+Al+Cr≤2 wt. %.

The invention can be applied both to hot and cold-rolled steels and corresponding flat steel products.

Preferably the invention is used to prepare cold strip steel products in the form of cold-rolled flat products (e.g. coils).

It is an advantage of the invention that compared to many other process approaches, it is less energy-consuming, faster and more cost-effective.

It is an advantage of the steel product that has been produced from an alloy and using the two-stage method of the invention that it has a very good formability. The tensile strength of the steel product is significantly greater than 700 MPa and can reach 1200 MPa and more.

It is an advantage of the steel product that has been produced from an alloy and using the two-stage method of the invention that, as a result of the relatively homogeneous ultrafine microstructure compared to two-phase steel and TRIP steel, it has excellent forming properties during bending. In English TRIP stands for "TRansformation Induced Plasticity".

It is an advantage of the steel product that according to preferred embodiments of the invention comprises a structure with bainite, that it has significantly better bending properties and also a better HET value (HET stands in English for "hole expansion test").

Further advantageous embodiments of the invention form the subject matters of the dependent claims.

DRAWINGS

Exemplary embodiments of the invention are described in detail hereinafter with reference to the drawings.

DETAILED DESCRIPTION

Figure 1:
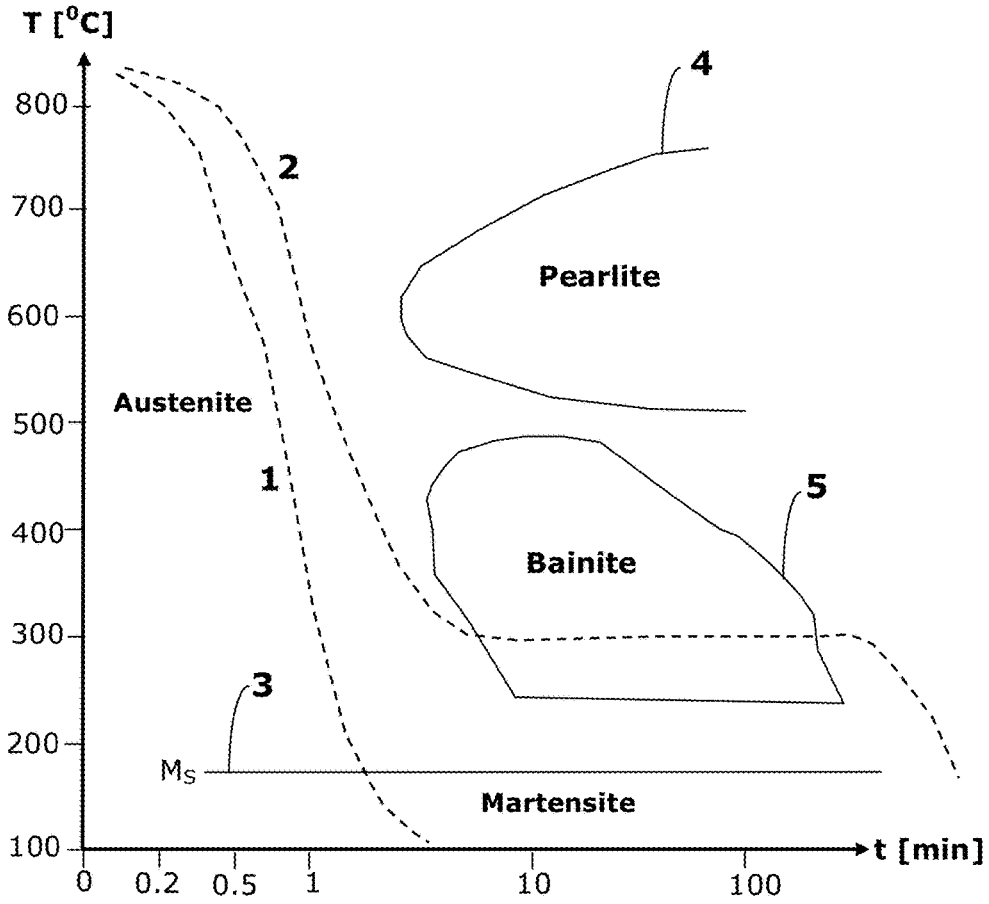
FIG. 1 shows a schematic diagram of a temperature-time diagram for cast iron which is to be understood as an example to explain basic mechanisms.

The invention is concerned with multi-phase medium manganese steel products which comprise martensite, ferrite and retained austenite regions or phases and optionally also bainite microstructures. That is, the steel products of the invention are characterized by a special structure arrangement which is here also designated according to the embodiment as multi-phase structure or, if bainite is present, as multi-phase bainite structure. In particular it is concerned with cold strip steel products.

In some cases in the following there is talk of steel (intermediate) products when it is a question of emphasizing that it is not the finished steel product but a preliminary or intermediate product in a multi-stage production process. The starting point for such production processes is usually a melt. In the following, the alloy composition of the melt is specified since on this side of the production process the alloy composition can be influenced relatively precisely (e.g. by adding components such as silicium). The alloy composition of the steel product normally differs only insignificantly from the alloy composition of the melt.

The term "phase" is defined here inter alia by its composition of fractions of the components, enthalpy content and volume. Different phases are separated from one another by phase boundaries in the steel product.

The "components" or "constituents" of the phases can either be chemical elements (such as Mn, Ni, Al, Fe, C, . . . etc.) or neutral molecular aggregates (such as FeSi, $Fe_3C$, $SiO_2$, etc.) or charged molecular aggregates (such as $Fe^{2+}$, $Fe^{3+}$, etc.).

All quantities or fractional information are hereinafter given in percentage by weight (wt. % for short) unless mentioned otherwise. If information for the composition of the alloy or the steel product is given, in addition to the materials or substances explicitly listed, the composition comprises as basic material iron (Fe) and so-called unavoidable impurities which always occur in the melt bath and are also shown in the resulting steel product. All wt. % information should therefore always be made up to 100 wt. %.

The mild medium manganese steel products of the invention all have a manganese content which is between 3.5 and 4.9 wt. %, where here also the specified limits belong to the range for this purpose.

According to the invention, steel products which proportionately comprise a bainite microstructure are preferred. A bainite microstructure is a type of intermediate stage structure which is typically formed at temperatures between those for the pearlite or martensite formation, as will be explained in detail by reference to FIG. 6A to 6D. The conversion into a bainite microstructure is usually in competition with the conversion into a pearlite structure.

The bainite microstructure according to the invention usually occurs in a type of conglomerate together with ferrite.

The invention focuses on a combination of alloy composition (of the melt) and process steps for the heat treatment of the steel intermediate product in order to achieve fractions of bainite microstructure in the overall structure of the steel product.

In all embodiments both the information in matters of alloy composition and also the process steps of the invention are jointly used, since the best results are thus achieved. However also taking into account the statements in matters of alloy composition, already yields remarkable results for example in relation to the formability (e.g. during cold rolling).

The steel products of the invention can be produced using any smelting method. These steps are not the subject matter of the invention. Details are not explained here since they are sufficiently known to the person skilled in the art. The starting point is always an alloy of the melt or of the steel intermediate product which according to the invention at least meets the following criteria, which comprises the following fractions in addition to iron:

- a carbon fraction C between 0.09 and 0.15 wt. %,
- a manganese fraction Mn in the range of 3.5 wt. % Mn 4.9 wt. %. The manganese fraction Mn in all embodiments of the invention preferably lies between 4.1 and 4.9 wt. %.

The aluminium fraction Al in all embodiments of the invention preferably lies in the range of $0.0005 \leq Al \leq 1$ wt. % and in particular in the range of $0.0005 \leq Al \leq 0.0015$.

Preferably all embodiments of the invention comprise
- a silicium fraction Si,
- an aluminium fraction Al, and
- a chromium fraction Cr.

It is important that the following relationship holds for the silicium fraction Si, aluminium fraction Al and chromium fraction Cr: 0.3 wt. $\% \leq Si+Al+Cr \leq 3$ wt. % and in particular 0.3 wt. $\% \leq Si+Al+Cr \leq 2$ wt. %. As a result of this specification of the relationship between the silicium fraction Si, the aluminium fraction Al and the chromium fraction Cr, a stabilization of the ferritic phase(s) in the steel product is achieved. The ferritic phase(s) have a not insignificant fraction of the ultrafine average grain size of the steel product.

Preferably all the embodiments of the invention comprise a chromium fraction Cr which is less than 0.4 wt. %.

In addition or additionally to the chromium fraction Cr, all embodiments of the invention comprise a silicium fraction Si which lies between 0.25 and 0.7 wt. %. In particular, the silicium fraction lies in the range $0.3 \leq Si \leq 0.6$.

According to the invention, the alloy of the steel products in all embodiments preferably comprises silicium fractions Si or aluminium fractions Al. By reducing the silicium fractions Si and aluminium fractions Al compared to other previously known steels, the bainitization can be intensified. That is, the reduction of the silicium fractions Si and aluminium fractions Al, as specified by the invention, leads to a promotion of the bainitic conversion. This is achieved by shifting the bainite region 50 in the conversion diagram (see FIG. 5A to 6D).

Figure 6A:
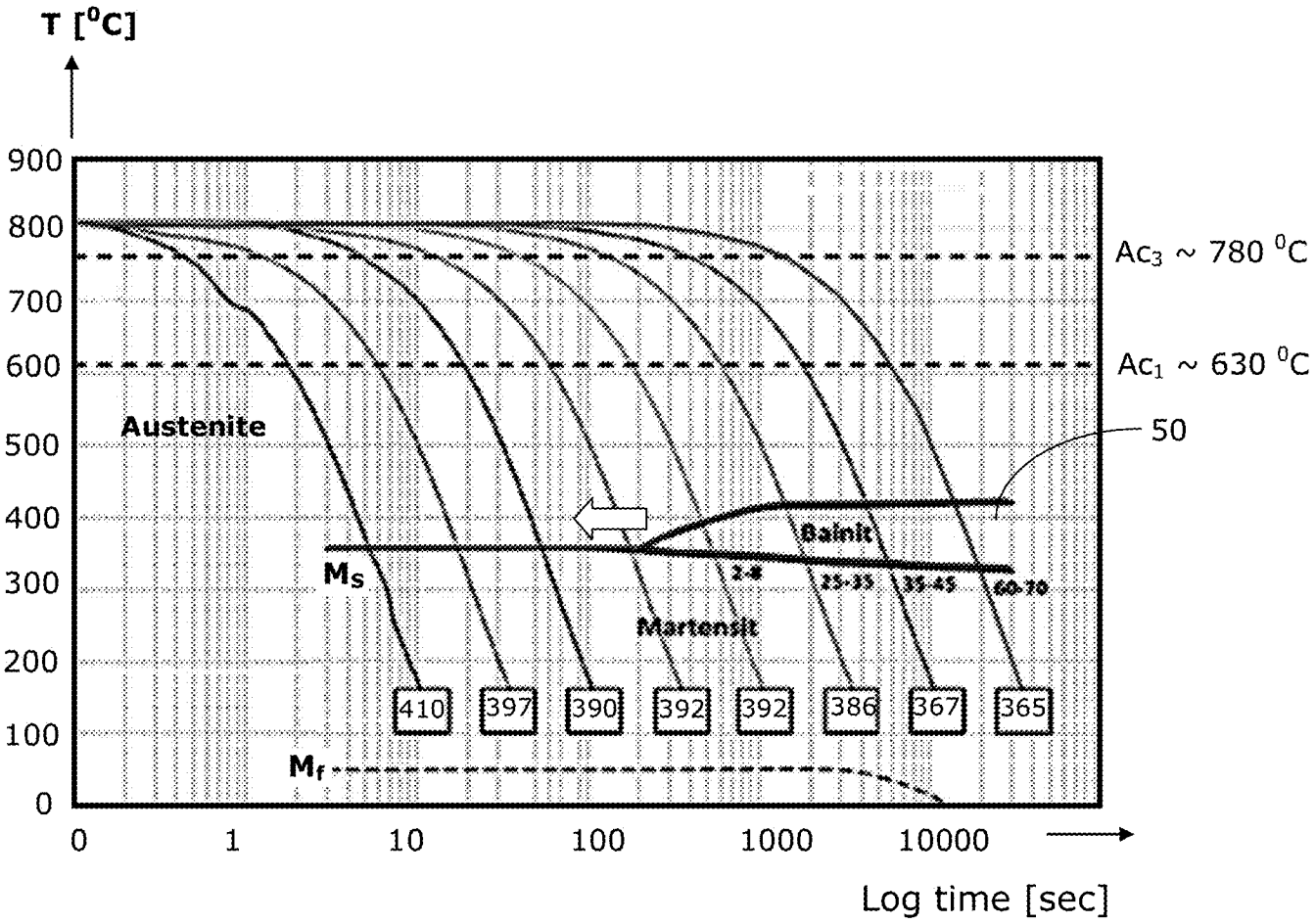
FIG. 6A shows a temperature-time diagram (called continuous ZTU-diagram; in English "continuous cooling transformation diagram") for a melt MF232, where the time is shown on a logarithmic scale.

FIG. 6A shows a continuous ZTU diagram for a first alloy according to the invention (called melt MF232), which has been subjected to various processing steps. Table 2 shows the specific alloy composition of the melt LF232 and other exemplary melts of the invention.

A ZTU diagram is a material-dependent time-temperature conversion diagram. That is, a ZTU diagram shows the extent of the conversion as a function of time for a continuously decreasing temperature. Overall eight curves are plotted in this diagram and in the diagrams of FIGS. 6B, 6C and 6D. The alloys whose curves are shown in these ZTU diagrams all have the compositions given in Table 2.

Figure 4A:
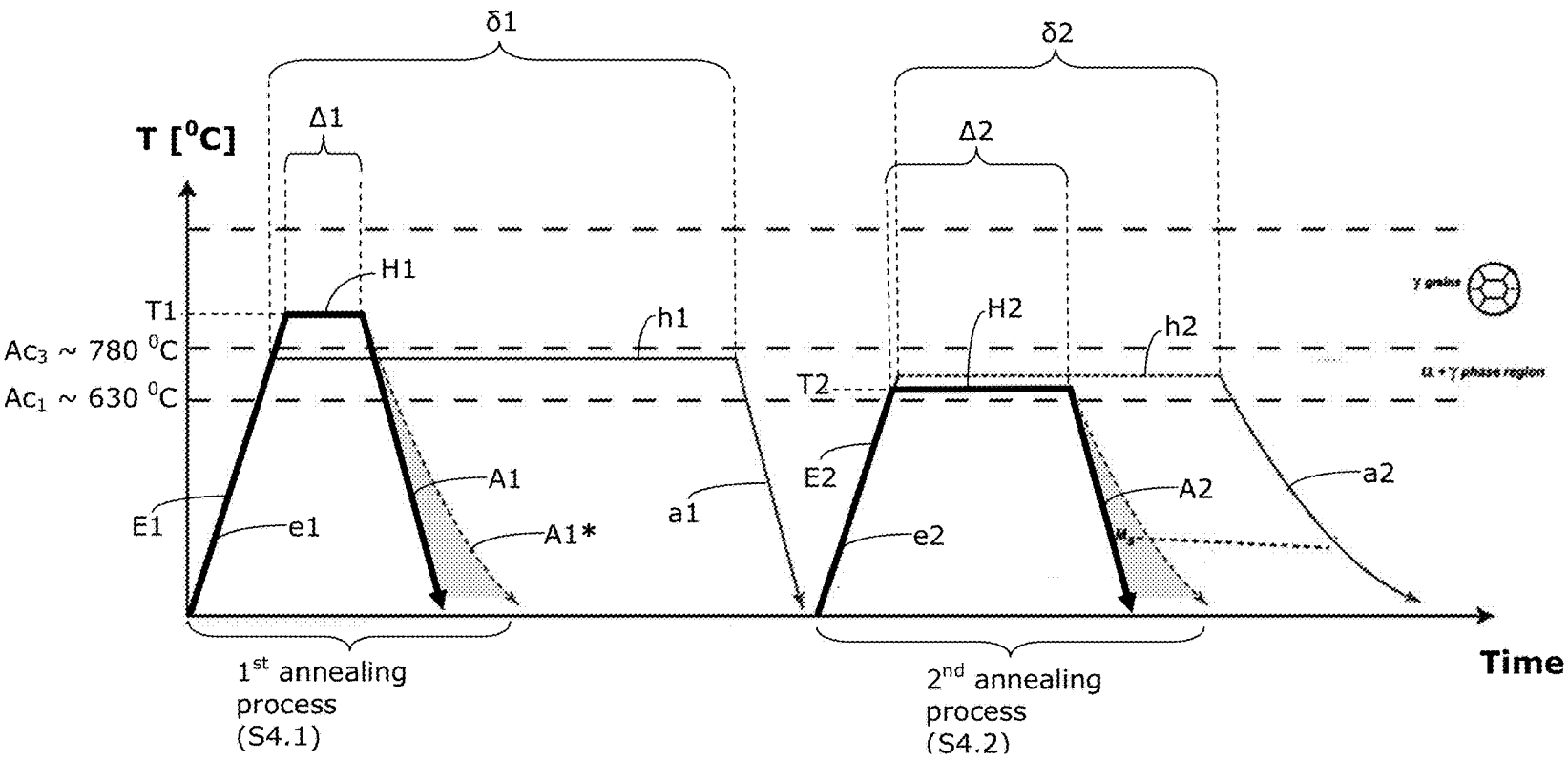
FIG. 4A shows a schematic diagram of an exemplary temperature-time diagram for a two-stage heat treatment of a steel (intermediate) product of the invention, where a previously known two-stage method (according to Arlazarov et al.) is also shown in the same diagram for comparison.
Figure 6B:
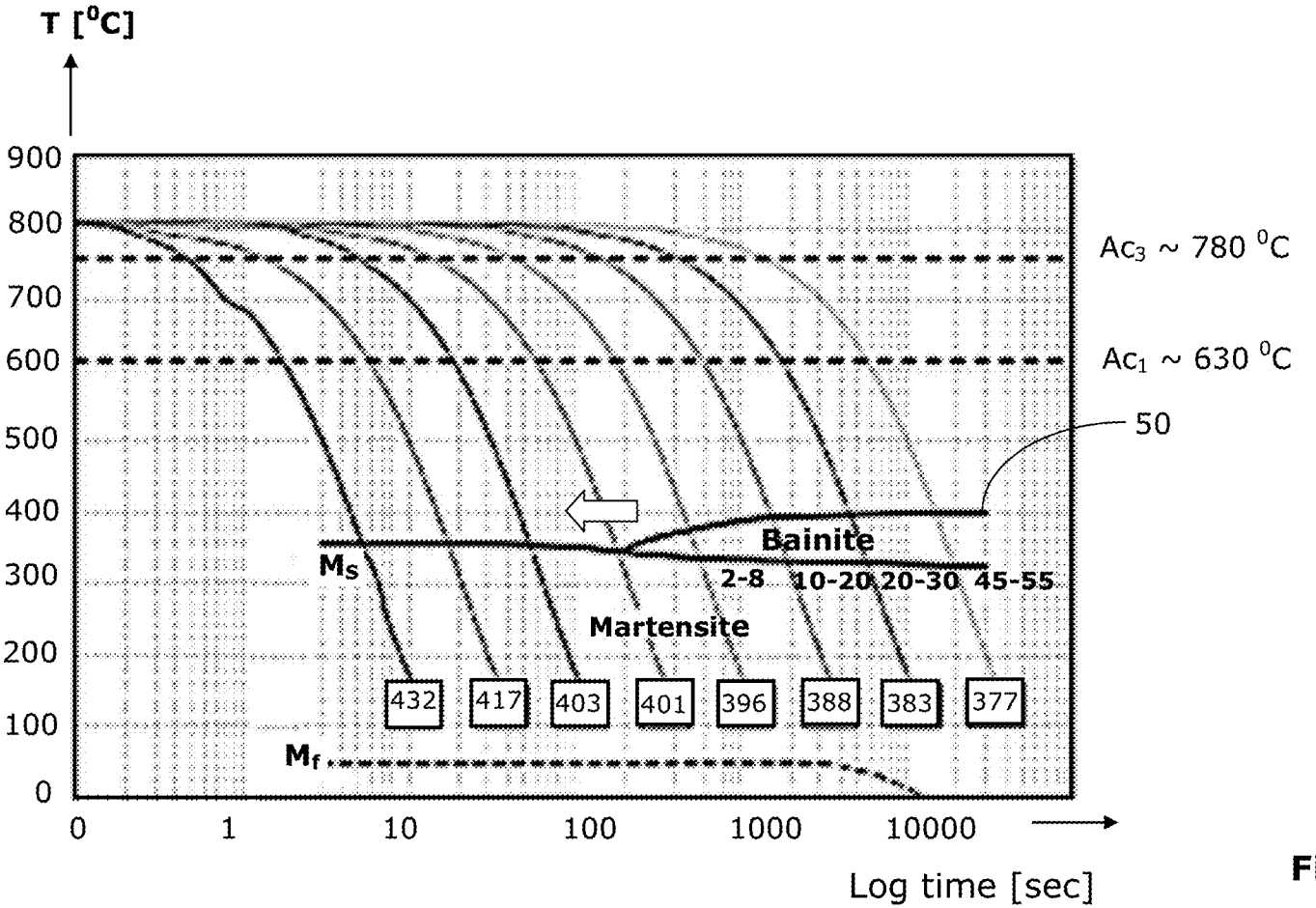
FIG. 6B shows a temperature-time diagram for a melt MF233.
Figure 6C:
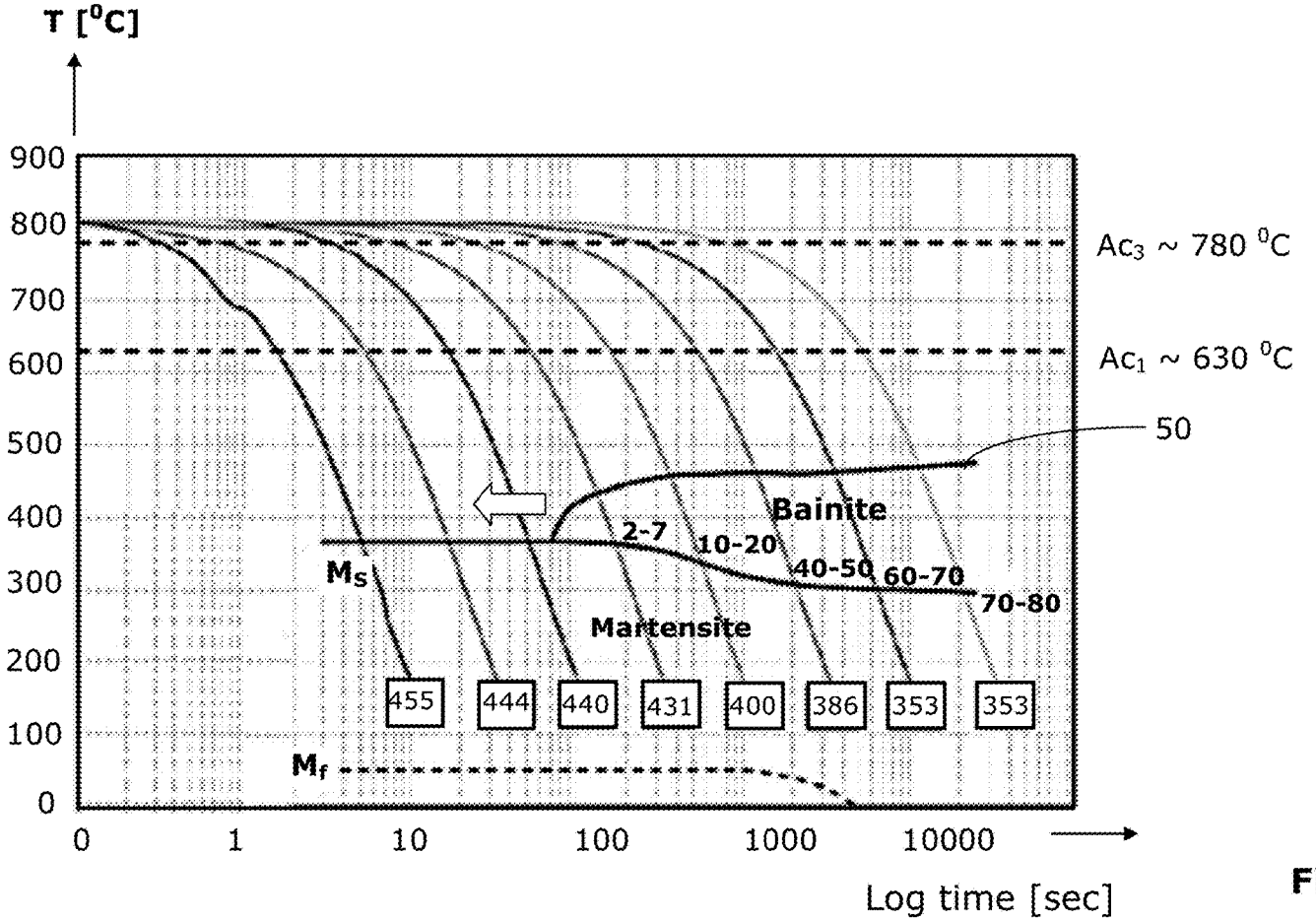
FIG. 6C shows a temperature-time diagram for a melt MF230.
Figure 6D:
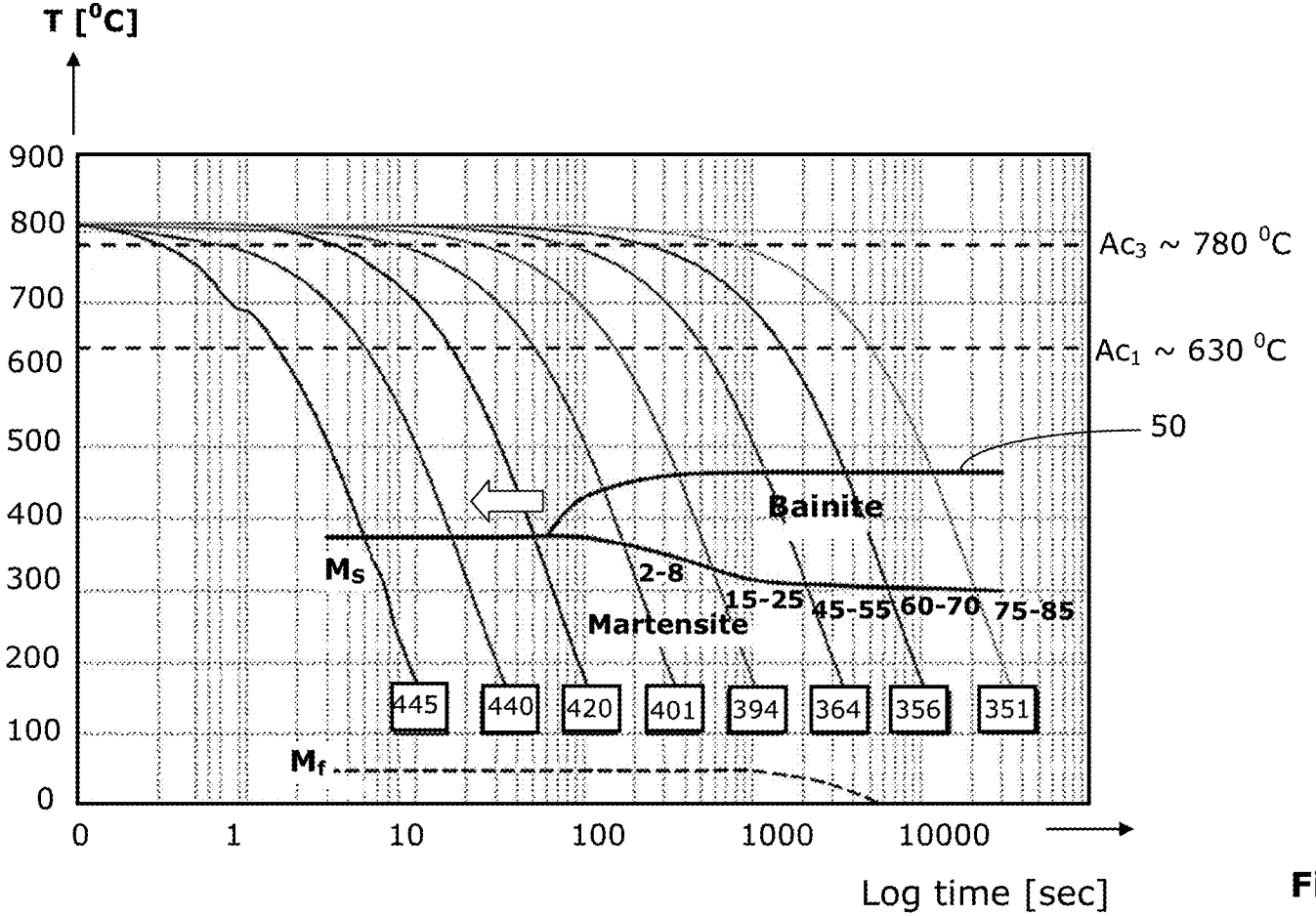
FIG. 6D shows a temperature-time diagram for a melt MF231.

The melt 232 according to FIG. 6A, melt 233 according to FIG. 6B, melt 230 according to FIG. 6C and melt 231 according to FIG. 6D were all subjected to the following heat treatment: heating rate 270° C./min for the heating E1, austenitization temperature T1=810° C., holding time Δ1=5 min, T2=650° C., holding time Δ2=4 h (see e.g. FIG. 4A).

The further one of the eight curves in the respective diagram of FIGS. 6A to 6D lies to the left, the more rapidly the cooling A1 takes place (see e.g. FIG. 4A). Curves lying further to the right relate to steel products which are cooled more slowly. At the lower end of each of these curves, a value for the Vickers hardness $HV_{10}$ ($HV_{10}$ means that the Vickers hardness measurement was carried out with a force of 10 kg) of the respective steel product is shown in a box. In addition, the bainite region 50 (similarly to the bainite region 5 in FIG. 1), the martensite starting temperature $M_S$ (similarly to the line 3 in FIG. 1) and the temperature $M_f$ are shown in each case in FIGS. 6A to 6D. $M_f$ is the martensite end temperature which is designated in English as "martensite finish temperature". The martensite finish temperature $M_f$ is the temperature at which the conversion into martensite is ended when considered thermodynamically. Also shown are the temperature thresholds $Ac_3$ and $Ac_1$ (see also FIGS. 4A and 4B). The region between $Ac_3$ and $Ac_1$ is designated as $\alpha+\gamma$ phase region.

As a result of a suitable reduction in the silicium fractions Si and aluminium fractions Al compared with previously known alloys, as already indicated, the bainite region 50 in the diagram is shifted. In FIGS. 6A to 6D, a block arrow pointing to the left is shown in each case approximately in the middle of the diagram. This block arrow is intended to indicate schematically that as a result of a reduction in the silicium fractions Si and aluminium fractions Al (compared to the prior art), the bainite region 50 is shifted to the left. Typically during rapid cooling (e.g. with water) substantially only martensite is formed. As a result of the shift of the bainite region 50 to the left, bainite microstructures are already formed in the steel product with relatively rapid cooling.

The figures below the bainite region 50 in FIGS. 6A to 6D indicate the volume percentage of the structure which is converted into bainite.

Inter alia the following statements can be deduced from FIGS. 6A to 6D, where it should be noted that various effects are partially compensated or superposed:

- a slight increase in the nitrogen fraction in the alloys according to the invention results in a higher Vickers hardness;
- a slight increase in the carbon fraction (e.g. from 0.100 wt. % to 0.140 wt. %) with a simultaneous reduction in the manganese fraction (e.g. from 4.900 wt. % to 4.000 wt. %) in the alloys according to the invention results in a higher Vickers hardness (see in comparison the diagrams of FIGS. 6A and 6C).

According to the invention, the two-stage annealing process is preferably carried out for all alloy compositions so that particularly during the first annealing process (see S4.1 in FIG. 4A or 4B and FIG. 3) the cooling curve A1 of the steel (intermediate) products runs so that it passes through the region of bainite formation 50.

Preferably all the embodiments of the alloy composition additionally comprise a nitrogen fraction N which lies in the range between 0.004 wt. % and 0.012 wt. %, which corresponds to 40 ppm to 120 ppm. In particular the nitrogen fraction N lies in the range between 0.004 wt. % and 0.006 wt. % which corresponds to 40 ppm 60 ppm.

Figure 3:
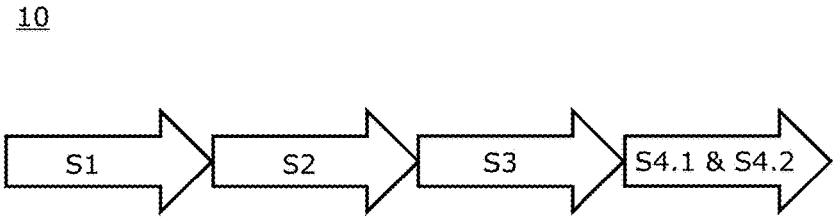
FIG. 3 shows a schematic diagram of process steps according to the invention.
Figure 4B:
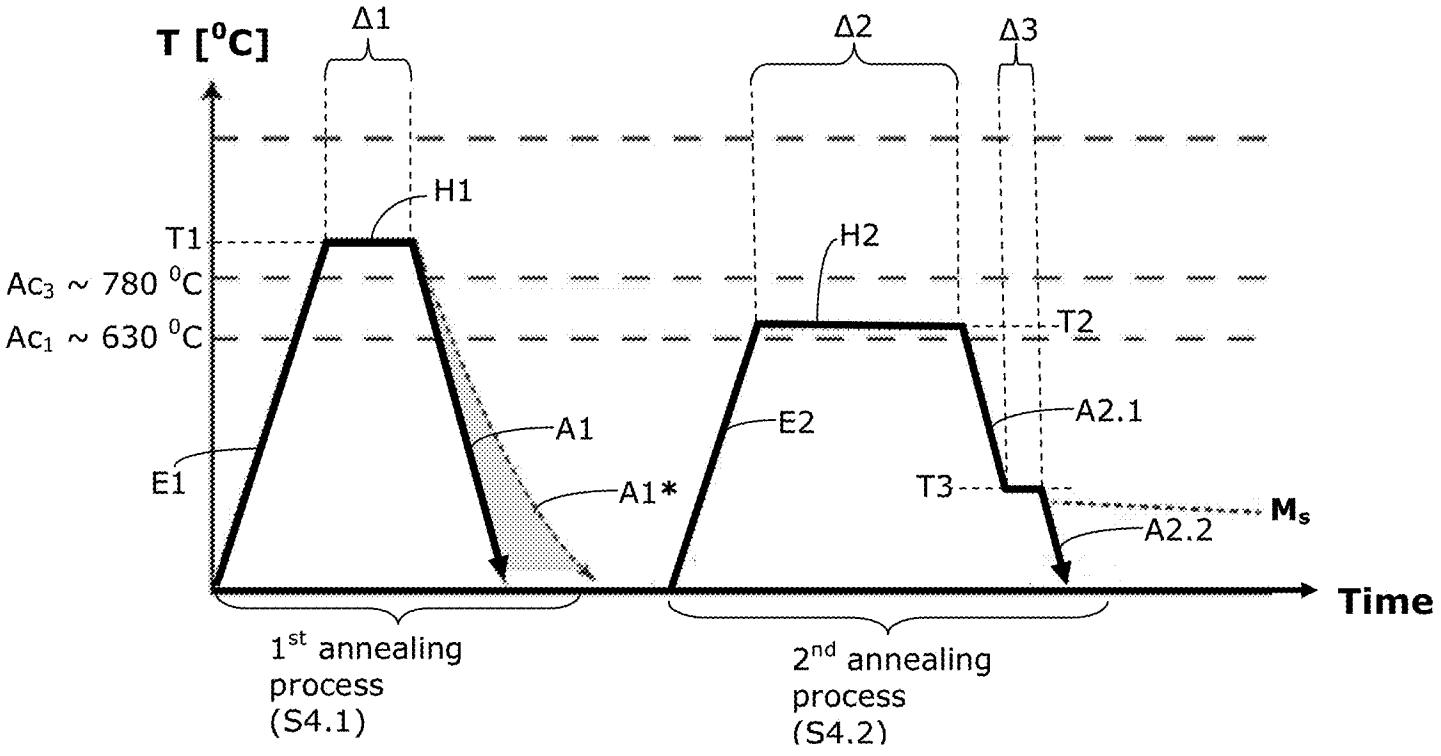
FIG. 4B shows a schematic diagram of an exemplary temperature-time diagram for another two-stage heat treatment of a steel (intermediate) product of the invention, where an interim holding takes place during cooling.

A steel (intermediate) product having an alloy composition according to one or more of the preceding paragraphs is typically subjected to the following process steps 10, as depicted in highly schematic form in FIG. 3 by means of block arrows:

- hot rolling (step S1)
- pickling with oxygen (e.g. by using an acid such as $HNO_3$) (step S2),
- cold rolling (step 3) and
- two-stage annealing according to the invention (substeps S4.1 and S4.2 according to FIG. 4A or according to FIG. 4B).

Optionally, in all embodiments a pre-annealing step (e.g. with T~650° C. and a duration of 10 to 24 hours) can be inserted as an intermediate step between the pickling (step S2) and the cold rolling (step S3) (not shown in FIG. 3). The pre-annealing step can be carried out in a nitrogen atmosphere.

Such a pre-annealing step can however be inserted in all embodiments as required, after the cold rolling (step S3).

FIG. 4A shows a schematic diagram of an exemplary temperature-time diagram for a first two-stage heat treatment of a steel (intermediate) product of the invention. A previously known two-stage process according to Arlazarov et al. is also shown in the same diagram for comparison in order to be able to better indicate essential differences.

A two-stage annealing process having the following steps is preferably used in all embodiments within the framework of the annealing according to the invention (the reference numbers relate to the diagram in FIG. 4A and to the diagram in FIG. 4B):

1. executing a first annealing process having the following substeps:
   a. heating E1 a steel (intermediate) product to a first holding temperature T1, which lies above 780° C. (e.g. T1=810° C.),
   b. holding the steel (intermediate) product during a first time period Δ1 at the first holding temperature T1 (e.g. Δ1=5 min),
   c. cooling A1 the steel (intermediate) product,
2. executing a second annealing process having the following substeps:
   a. heating E2 the steel (intermediate) product at a holding temperature T2, which lies above 630° C. and below 660° C. (e.g. T2=650° C.),
   b. holding H2 the steel (intermediate) product during a second time period Δ2 at the holding temperature T2 (e.g. Δ2=4 h), c. cooling A2 the steel (intermediate) product in order to thus obtain a steel product which is here designated as steel product in each case.

The heating E1 during the first annealing process and/or the heating E2 during the second annealing process is preferably accomplished at a heating rate which lies between 4 Kelvin/second and 50 Kelvin/second. Good results are achieved particularly in the range between 5 Kelvin/second and 15 Kelvin/second.

The holding temperature T1 here always lies above the temperature threshold $Ac_3$. That is, the first holding temperature T1 is selected so that the steel (intermediate) product during the holding H1 is located in the austenitic range (on the right in the diagram designated by γ grains) above $Ac_3$=780° C. In the case of the exemplary embodiments shown in FIGS. 6A to 6D it holds that: T1=810° C.

The holding temperature T2 lies above $Ac_1$=630° C. and below 660° C. That is, the second holding temperature T2 is selected so that the steel (intermediate) product during the holding H2 is located in the two-phase range (on the right in the diagram designated by α+γ phase region).

Preferably during the holding H1 and/or during the holding H2 the temperature of the steel (intermediate) product is kept substantially constant.

Preferably in all embodiments the holding H1 lasts between 3 and 10 minutes and preferably between 4 and 5 minutes. That is, the following statement holds: 3 min≤Δ1≤10 min, or 4 min≤Δ1≤5 min. In the case of the exemplary embodiments shown in FIGS. 6A to 6D it holds that: Δ1=5 min.

Preferably, in all embodiments the holding H2 lasts between 3 and 5 hours and preferably between 3.5 and 4.5 hours. That is, the following statement holds: 3 h≤Δ2≤5 h, or 3.5 h≤Δ2≤4.5 h.

A holding time of Δ2≈4 h at a holding temperature of T2≈650° C. has proved quite particularly successful.

The cooling of the steel (intermediate) product is accomplished in all embodiments during the first annealing process and/or during the second annealing process at a cooling rate which lies between 25 Kelvin/second and 200 Kelvin/second. Preferably, in all embodiments the cooling rate lies between 40 Kelvin/second and 150 Kelvin/second. The curves A1* in FIG. 4A and FIG. 4B each show a cooling process which begins with a high cooling rate of about 150 Kelvin/second and whose cooling rate then decreases towards 40 Kelvin/second. Thus, the curves A1* do not have a rectilinear profile but a curved curve profile. The curves A1 in FIGS. 4A and 4B each show a linear cooling process which takes place with a high cooling rate of about 150 Kelvin/second.

The cooling during the first annealing process and/or during the second annealing process can take place linearly (e.g. at 150 Kelvin/second) or along a curved curve (e.g. along the curve A1*).

The cooling during the second annealing process can take place as shown in FIG. 4B. The cooling is here composed of three substeps. In step A2.1 a rapid (e.g. linear) cooling takes place from T2 to a holding temperature T3 which lies in the range between 370° C. and 400° C. Preferably this holding temperature T3 is about 380° C. The holding time Δ3 is typically between 2 min and 6 min. Preferably this holding time is Δ3=5 min.

When a method according to FIG. 4B is used, the holding temperature T3 is preferably selected in all embodiments so that it lies above the temperature $M_S$.

During the first cooling A1 or A1* according to the invention, in addition to martensite phases (depending on alloy composition and process control), the desired bainite microstructures are formed when the alloy is predefined according to the invention and the first annealing process is carried out according to the invention.

In the previously known process according to the prior art, which is shown by the curve profile e1, h1, a1 and e2, h2, a2 in FIG. 4A, the temperature during the first holding h1 lies significantly lower than during the first holding H1 according to the invention. In addition, the first holding duration δ1 is significantly longer. In the specific example, it holds for the first holding h1: T=750° C. and δ1=30 min. During the cooling a1 according to the prior art martensite phases are formed but no bainite microstructures. The temperature during the second holding h2 lies somewhat higher than during the second holding H2 according to the invention. In addition the second holding duration δ2 is significantly longer. In the specific example it holds for the second holding h2: T=670° C. and 1 h<δ2<30 h.

EBSD investigations were carried out to determine the grain orientation and sizes of various alloys of the invention. EBSD stands for "Electron BackScattered Diffraction". With the EBSD method it is possible to characterize grains having a diameter of only about 0.1 μm. In addition, the crystal orientation can be determined with a high precision by means of EBSD. In addition, further spatially resolved methods were used to investigate the individual grains and grain boundaries surface-analytically or electrochemically.

These investigations have confirmed that (depending on alloy composition and process control), in addition to the martensite structure, clearly measurable fractions of bainite microstructures are present in samples which have an alloy according to the invention and which have been subjected to the two-stage annealing process. e.g. according to FIG. 4A or 4B.

Figure 5:
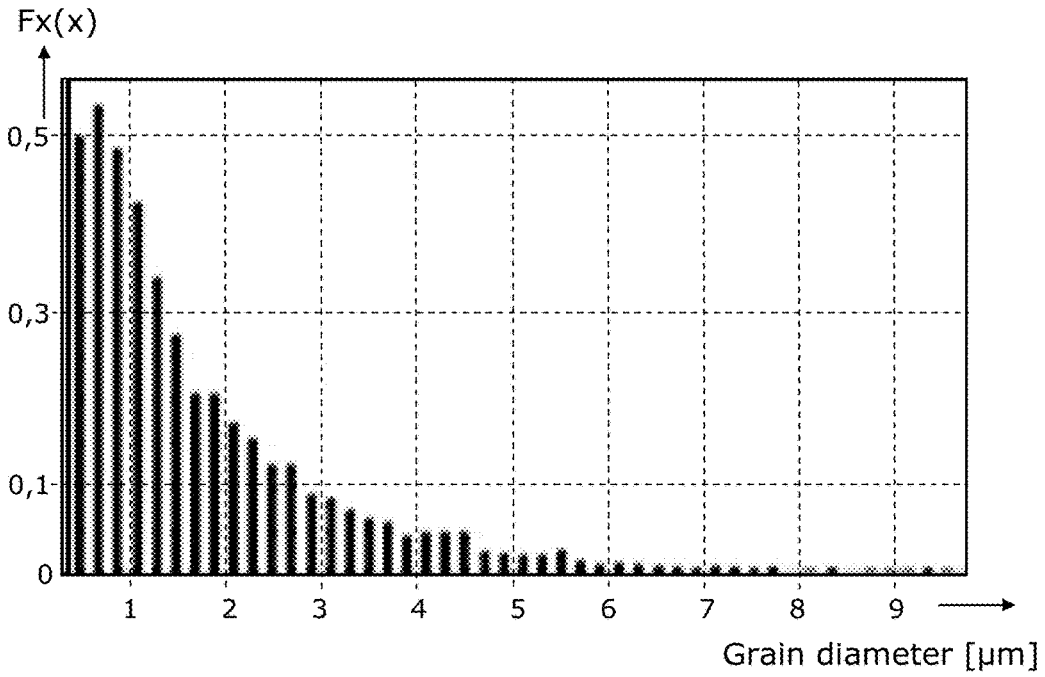
FIG. 5 shows a schematic diagram of the distribution function of the grain diameter of a steel product of the invention.

FIG. 5 shows a schematic diagram of the distribution function Fx(x) of the grain diameter of the bcc-α phase of a special steel product of the invention. bcc stands for "body centered cubic". The special steel product whose distribution function Fx(x) of the grain diameter is shown in FIG. 5 has the following alloy composition according to the invention (in Table 1 the desired values of the melt are given):

TABLE 1

| [Wt. %] | Fe | C | Si | Mn | Al |
|---|---|---|---|---|---|
| Sample 231 | Remainder | 0.140 | 0.550 | 4.000 | 0.0005 |

By means of the distribution function Fx(x) in FIG. 5 it can be deduced that the predominant fraction of the grains of the alloy structure has a grain size between 0 and about 3 μm. Since the EBSD investigations used have a lower resolution limit of around 0.1 μm, the average distribution of the grain size of the bcc-α phase can be limited to the range of about 0.1 μm to about 3 μm. Further EBSD investigations have revealed that the distribution of the grain size of the fcc-γ phase can be limited to the range of about 0.25 μm to about 0.75 μm.

Figure 2:
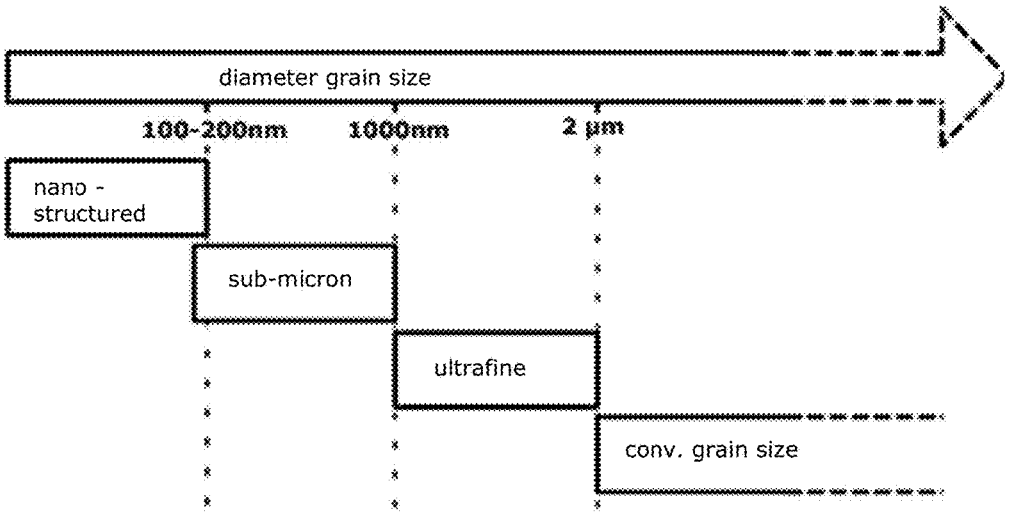
FIG. 2 shows a scale which enables a classification of steel products according to the diameter of the grain size.

FIG. 2 shows a common scale which enables steel products to be classified according to grain size. The steel products (sample 231) of the invention therefore lie in the range of ultrafine grains (if the average distribution of the entire structure is considered). This classification can also be applied to other alloy compositions of the invention. Therefore there is also talk here of an ultrafine multi-phase structure and of an ultrafine multi-phase bainite structure if detectable bainite microstructures are present, as is the case for example in sample 231.

If all the grain sizes are included in the analysis, for steel products according to the invention an overall grain size distribution in the range of 0.1 μm to about 3 μm (more than 80% of the grains lie in the window from about 0.1 μm to about 3 μm) can be determined.

Preferably the overall structure of the steel product according to the invention in all embodiments has a grain size between 1 and 2 μm, as could be determined by means of evaluations and measurements on steel products which originate from the melt MF231 (sample 231). Quite particularly preferred are steel products according to the invention having a grain size of about 1.5 μm.

According to the invention, particularly the grains of ferrite phases and the bainite microstructure are very fine. Particularly preferred therefore are alloys or steel products which have a combination of ferrite phases and bainite microstructures.

Further comparative EBSD investigations have confirmed that the holding duration Δ2 of the second annealing process is important in order to form or stabilize the ultrafine structure. The following holding duration 3 h≤Δ2≤5 h yields particularly advantageous results.

The following Table 2 shows the specific alloy composition in wt. % of various samples of the invention.

TABLE 2

| | Sample | | | |
|---|---|---|---|---|
| | 230 Steel product | 231 Steel product | 232 Steel product | 233 Steel product |
| Fe/remainder | X | X | X | X |
| C | 0.142 | 0.140 | 0.098 | 0.105 |
| Si | 0.520 | 0.540 | 0.320 | 0.340 |
| Mn | 4.120 | 4.070 | 4.940 | 4.970 |
| P | 0.0050 | 0.0051 | 0.0054 | 0.0057 |
| S | 0.0083 | 0.0084 | 0.0070 | 0.0075 |
| Al | 0.0100 | 0.0090 | 0.0090 | 0.009 |
| Cr | 0.016 | 0.016 | 0.016 | 0.015 |
| Ni | 0.011 | 0.012 | 0.012 | 0.011 |
| Mo | 0.004 | 0.005 | 0.006 | 0.005 |
| Cu | 0.015 | 0.005 | 0.015 | 0.006 |
| V | 0.002 | 0.008 | 0.002 | 0.008 |
| Nb | <0.002 | <0.002 | <0.002 | <0.002 |
| Ti | <0.001 | <0.016 | <0.01 | <0.015 |

The following Table 3 shows various characteristic values of steel products in the form of cold strip having the specific alloy composition of samples 231 and 233 of the invention after these have undergone a two-stage annealing process (according to FIG. 4A). $R_m$ is the tensile strength in MPa, $A_{total}$ is the ultimate elongation in % (the ultimate elongation is proportional to the ductility), $R_{mx}$ $A_{total}$ is the product of the tensile strength and ultimate elongation in MPa %.

EBSD investigations and TEM investigations (e.g. of sample 231) have shown that the two-stage annealing process according to FIG. 4A yields resulting steel products which have a bainite content of about 5%. TEM here stands for transmission electron microscopy.

Table 3 shows the best results in terms of tensile strength in relation to the product of $R_{mx}$ $A_{total}$. Specifically the following parameters were predefined for the two-stage annealing process (according to FIG. 4A): T1=810° C., Δ1=5 min, T2=650° C., Δ2=4 h. Comparative tests using conventional single-stage annealing processes and conventional two-stage annealing processes show that very good values—particularly as far as the product $R_{mx}$ $A_{total}$ is concerned—can be achieved with the alloy composition and the method of the invention.

TABLE 3

| [Wt. %] | $R_m$ [MPa] | $A_{total}$ [%] | Rmx Atotal [MPa %] | Structure | Overall grain size [μm] |
|---|---|---|---|---|---|
| Sample 231 | >900 | 32 | >27000 | up to 5% martensite, up to 5% bainite, about 40 to 70% ultrafine ferrite, 5%-15% retained austenite | 0.1-10 (of which more than 80% between 1 μm and 2 μm) |
| Sample 233 | 944 | 28 | 26200 | about 20% martensite and/or bainite, about 70% ultrafine ferrite, 10%-15% retained austenite | 0.1-10 (of which more than 80% between 0.1 μm and 3 μm) |

Samples having an alloy composition according to the invention which have undergone a two-stage annealing process (according to FIG. 4A or 4B) and which have a tensile strength which lies above $R_m$=750 MPa and/or which have a product $R_{mx}$ $A_{total}$ which lies above 25000 MPa % are particularly preferred. Particularly preferred are alloy compositions which have a tensile strength which lies above $R_m$=900 MPa and/or have a product $R_{mx}$ $A_{total}$ which lies above 25200 MPa % and in particular above 27000 MPa %, as for sample 231.

EBSD investigations and TEM investigations (e.g. for sample 231) have shown that the two-stage annealing process according to FIG. 4B yields resulting steel product which have a bainite content of about 20%.

EBSD investigations and TEM investigations (e.g. for sample 231) have shown that the fraction of retained austenite regions or phases is preferably between 5 and 15% relative to volume.

The invention claimed is:

1. Method for heat treating a manganese steel product: the method comprising the following steps:

providing a steel product, selected from the group consisting of a hot-rolled manganese steel product and a cold rolled manganese steel product, whose alloy comprises:

a carbon fraction (C) between 0.09 and 0.15 wt. %, and a manganese fraction (Mn) in the range of 4.0 wt. %≤Mn≤4.9 wt. %, and fractions of bainite microstructure, performing a first annealing process (S4.1) with the following substeps heating (E1) the steel product to a first holding temperature (T1), which lies above 780° C., holding (H1) the steel product during a first time period (Δ1) at the first holding temperature (T1) thereby allowing austenite (v) formation, cooling (A1) the steel product, performing a second annealing process (S4.2) with the following substeps heating (E2) the steel product to a holding temperature (T2), which lies above 630° C. and below 660° C., holding (H2) the steel product during a second time period (Δ2) at the holding temperature (T2) thereby allowing the formation of the two phases ferrite and austenite, cooling (A2) the steel product, wherein the cooling (A1; A2) of the steel product during the first annealing process (S4.1) and during the second annealing process (S4.2) is carried out at a cooling rate which lies between 25 Kelvin/second and 200 Kelvin/second, and wherein the second annealing process (S4.2) is carried out subsequently to the first annealing process (S4.1).

2. The method according to claim 1 wherein the first cooling of the steel product (A1) and the second cooling of the steel product (A2) are carried out at a cooling rate which lies between 40 Kelvin/second and 150 Kelvin/second.

3. The method according to claim 1, wherein during the first annealing process (S4.1) and during the second annealing process (S4.2) the heating (E1; E2) is carried out at a heating rate which lies between 4 Kelvin/second and 50 Kelvin/second.

4. The method according to claim 1, wherein the alloy additionally comprises:

a silicium fraction (Si), an aluminium fraction (Al), and a chromium fraction (Cr), wherein the following relationship between the silicium fraction (Si), aluminium fraction (Al) and chromium fraction (Cr) holds: 0.3 wt. %≤Si+Al+Cr≤3 wt. %.

5. The method according to claim 4, wherein the chromium fraction (Cr) is always less than 0.4 wt. % and the silicium fraction (Si) lies between 0.25 and 0.7 wt. %.

6. The method according to claim 5, wherein the silicium fraction (Si) lies in the range of 0.3≤Si≤0.6.

7. The method according to claim 4, wherein the following relationship between the silicium fraction (Si), aluminium fraction (Al) and chromium fraction (Cr) holds: 1.2 wt. %≤Si+Al+Cr≤2 wt. %.

8. The method according to claim 1, wherein the alloy composition additionally comprises a nitrogen fraction (N) which lies in the range between 0.004 wt. % and 0.012 wt. %.

9. The method according to claim 8, wherein the nitrogen fraction (N) lies in the range between 0.004 wt. % and 0.006 wt. %.

10. The method according to claim 1, wherein during the first annealing process (S4.1) the cooling (A1) of the steel product is carried out so that the course of the temperature (T) of a corresponding cooling curve plotted over the time (t) passes through a region of bainite formation (50).

11. The method according to claim 1, wherein by admixing or adding silicium (Si) and aluminium (Al) a region of bainite formation (50) during cooling (A1) of the steel product is shifted in a direction of a more rapid cooling.

12. The method according to claim 1, wherein the first time period (Δ1) lies in the range of 3≤Δ1≤10 minutes.

13. The method according to claim 12, wherein the first time period (Δ1) lies in the range of 4≤Δ1≤5 minutes.

14. The method according to claim 1, wherein the second time period (Δ2) is in the range of 3≤Δ2≤5 hours.

15. The method according to claim 14, wherein the second time period (Δ2) is in the range of 3.5≤Δ2≤4.5 hours.

* * * * *